US007390220B1

(12) United States Patent
Wu

(10) Patent No.: US 7,390,220 B1
(45) Date of Patent: Jun. 24, 2008

(54) CABLE CONNECTOR WITH ANTI CROSS TALK DEVICE

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/891,795

(22) Filed: Aug. 13, 2007

(51) Int. Cl.
*H01R 13/648* (2006.01)

(52) U.S. Cl. ..... 439/608; 439/939

(58) Field of Classification Search ..... 439/95, 439/98, 99, 608, 609, 610, 660, 701, 939
See application file for complete search history.

(56) References Cited

U.S. PATENT DOCUMENTS 4,824,383 A * 4/1989 Lemke ..... 439/108
5,085,596 A * 2/1992 Bowen et al. ..... 439/497
6,454,605 B1 9/2002 Bassler et al.
6,659,801 B2 * 12/2003 Nishio et al. ..... 439/610
7,090,534 B2 * 8/2006 Wu et al. ..... 439/607
7,165,981 B2 * 1/2007 Bassler et al. ..... 439/101
2002/0142659 A1 * 10/2002 Nishio et al. ..... 439/610
2004/0002262 A1 * 1/2004 Murayama et al. ..... 439/608
2005/0260872 A1 * 11/2005 Bassler et al. ..... 439/101
2006/0121783 A1 * 6/2006 Wu et al. ..... 439/607

* cited by examiner

*Primary Examiner*—James Harvey
(74) *Attorney, Agent, or Firm*—Wei Te Chung

(57) ABSTRACT

A cable connector (100) includes an insulated housing (2) defining a receiving space (20), a plurality of terminals (3) being arranged into an upper and a lower terminal rows and received in the insulated housing (2), a metal plate (5) disposed between the upper terminal row and the lower terminal row, and a cable (7) including a number of wires electrically connecting to the terminals (3) and the metal plate (5).

18 Claims, 6 Drawing Sheets

CABLE CONNECTOR WITH ANTI CROSS TALK DEVICE

BACKGROUND OF THE INVENTION

1. Field of the Invention

The present invention generally relates to a cable connector, and more particularly to a cable connector used in high-speed signal transmission.

2. Description of Related Art

In recent years, human has benefited much from the fast developing digital industry. The digital industry brings us a multiply of products, such as personal computer (PC) and consumer electronic (CE) products including TV, DVD player, game console, etc. Usually, either PC or CE product has a display for showing video, and a cable connector is needed to connect an interface of the display and a control device. A display port connector may be an ideal I/O port adapted for both PC and CE product. However, cross talk problem often occurs at interface section of the display port connector, which may influence the quality of signals.

Hence, an improved cable connector is highly desired to overcome the aforementioned problems.

SUMMARY OF THE INVENTION

Accordingly, an object of the present invention is to provide an anti cross talk cable connector to improve signal transmitting quality.

In order to achieve the object set forth, a cable connector in accordance with the present invention comprises an insulated housing defining a receiving space, a plurality of terminals being arranged into an upper and a lower terminal rows and received in the insulated housing, a metal plate disposed between the upper terminal row and the lower terminal row, and a cable including a number of wires electrically connecting to the terminals and the metal plate.

Other objects, advantages and novel features of the invention will become more apparent from the following detailed description when taken in conjunction with the accompanying drawings.

DETAILED DESCRIPTION OF THE INVENTION

Figure 1:
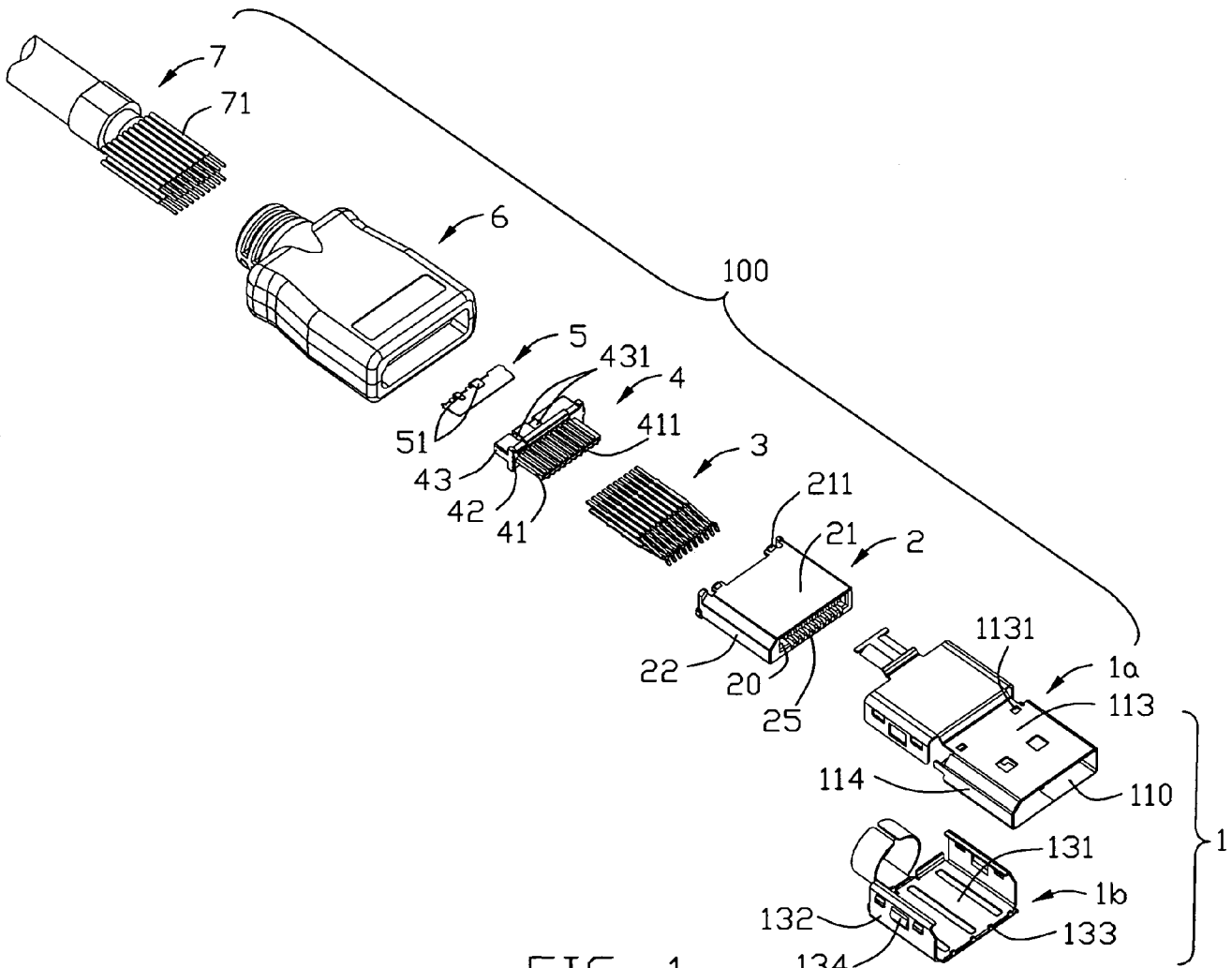
FIG. 1 is an exploded, perspective view of a cable connector in accordance with the present invention.
Figure 2:
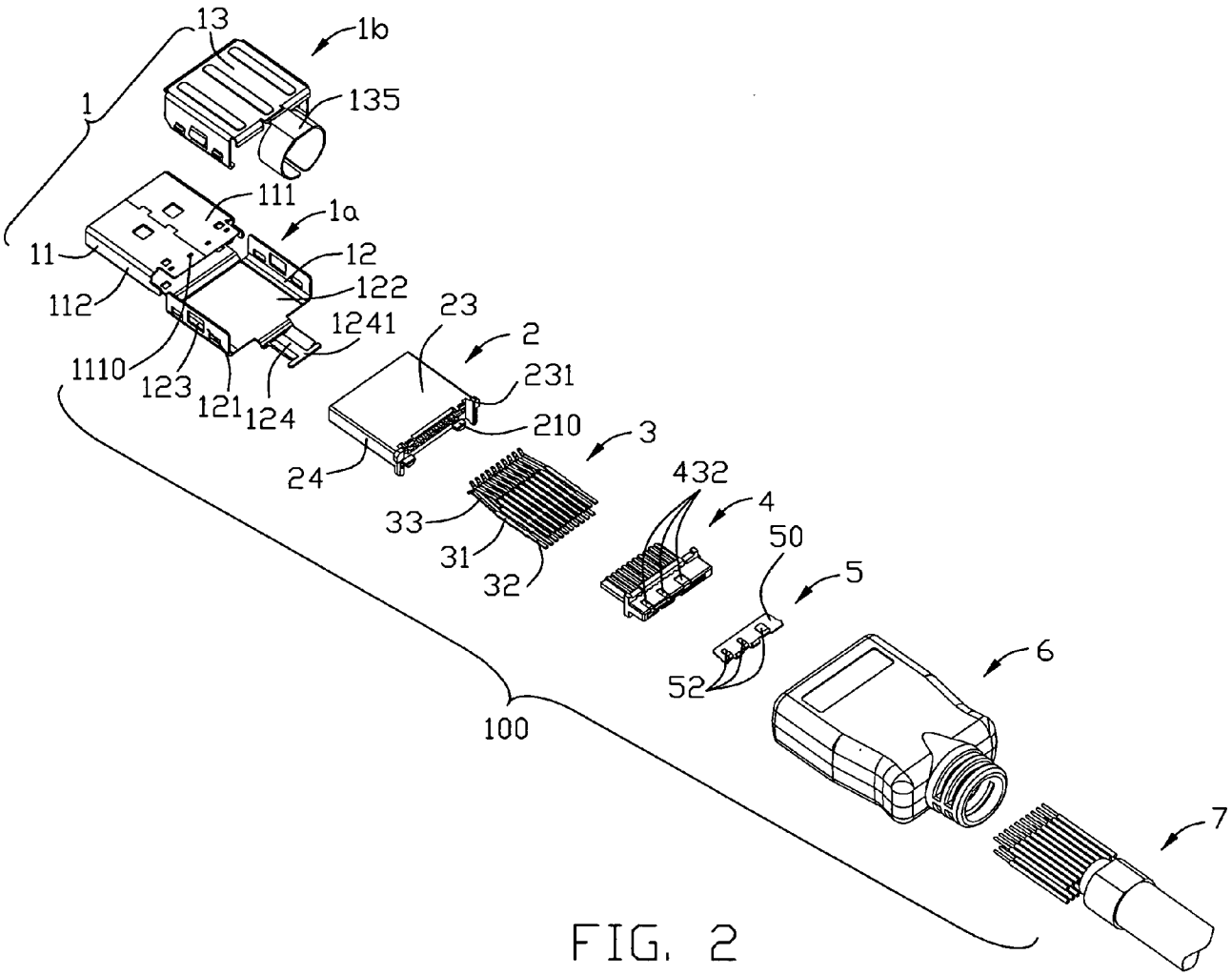
FIG. 2 is similar to FIG. 1, but viewed from another aspect.

Reference will now be made in detail to the preferred embodiment of the present invention.

Referring to FIGS. 1-6, a cable connector 100 in accordance with the present invention comprises an insulated housing 2, a plurality of terminals 3 arranged on a spacer 4 and then together received in the insulated housing 2, a metal plate 5 embedded in the spacer 4, a metal shell 1 enclosing the insulated housing 2, a cable 7 with a number of wires 71 respectively electrically joining to the terminals 3, and a cover 6 partially over molded the metal shell 1, the insulated housing 2, the spacer 4 and the cable 7.

The metal shell 1 comprises an upper first shield portion 1*a* and a lower second shield portion 1*b*. The upper first shield portion 1*a* includes an enclosing portion 11 which consists of a bottom side 111, an opposite top side 113, and a pair of transversal sides 112, 114 interconnecting the top and the bottom sides 113, 111 to form a hollow 110 for receiving the insulated housing 2. And the upper first shield portion 1*a* further includes an inverted U-shaped first cover portion 12 rearward extending from the top side 113 of the enclosing portion 11. The rear section of the bottom side 111 defines four holes 1110 thereon and the rear section of the top side 113 defines a pair of apertures 1131 either. And the rear section of the bottom side 111 further has a pair of apertures (not labeled) opposite to the apertures 1131. The inverted U-shaped first cover portion 12 also comprises a flat board portion 122 and a pair of upright sides 121 joining to edges of the flat board portion 122. The inverted U-shaped first cover portion 12 further has a sheet stretching portion 124 being slightly bent to arched configure and extending rearward from middle end edge of the flat board portion 122, and the stretching portion 124 further forms a flat stopper 1241 at the end edge thereof. Each upright side 121 defines three locking holes 123 with different sizes and arranged along mating direction. The lower second shield portion 1*b* includes U-shaped second cover portion 13 and a cylindrical-shaped cable holder 135 connecting to the lower second shield portion 1*b*. The U-shaped second cover portion 13 also comprises a board portion 131 and a pair of upright sides 132 joining to two edges of the board portion 131. Each upright sides 132 forms three locking tab 134 with different sizes corresponding to the locking holes 123 of the upright side 121 of the U-shaped first cover portion 12, and the forward edge of the board portion 131 further forms four tabs 133 thereon.

The insulated housing 2 comprises a top wall 21, an opposite bottom wall 23, and a pair of side walls 22, 24 connecting with the top and the bottom walls 21, 23 to form a receiving space 20. Both the top wall 21 and the bottom wall 22 defines a plurality of terminal passages 25 arranged in two distinct rows and offset from each other respectively. The rear portion of the top wall 21 forms two spaced apart protruding portions 210 each with a locking member 211 thereon. And the rear portion of the bottom wall 22 also forms a pair of protruding portions (not labeled) opposite to the protruding portions 210 and each protruding portion (not labeled) has a locking member. Each side wall 22, 24 extend rearward to form an expanded tab 231 at the end portion thereon.

Figure 6:
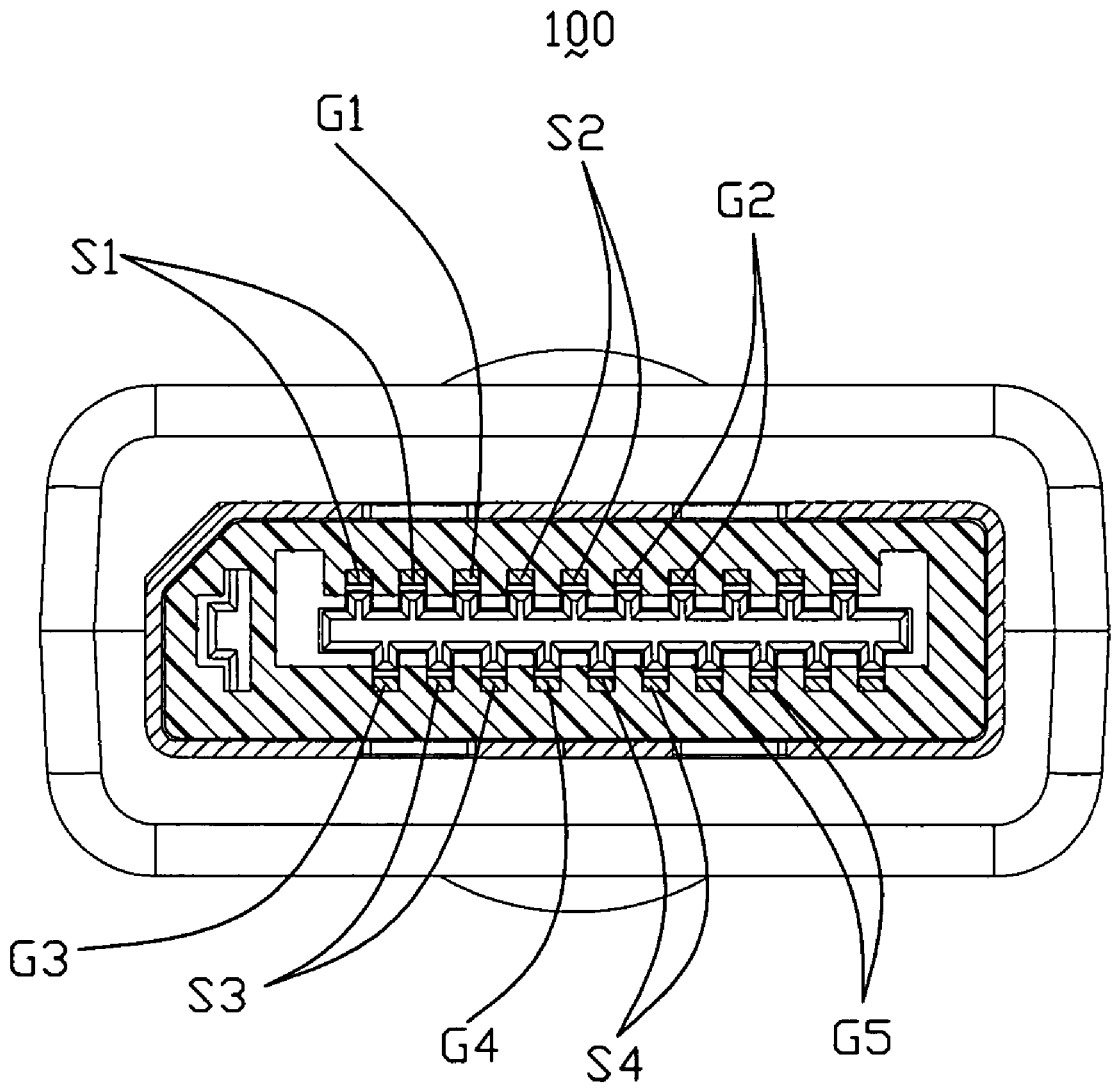
FIG. 6 is a cross-section view of FIG. 5 taken along line 6-6.

Each terminal 3 with identical configuration comprises a flat body portion 31, a curved mating portion 33 extending forward from a front end of the body portion 31, and a flat termination portion 32 extending rearward from a rear end of the body portion 31. The aforementioned terminals 3 are separated into two rows, the upper terminal row and the opposite lower terminal row. Referring to FIG. 6, both the upper terminal row and the lower terminal row have two pairs of differential signal terminal pairs S1, S2 and S3, S4, and the differential signal terminal pairs S1, S2 are offset from the differential signal terminal pairs S3, S4 along vertical (up-to-down) direction. The upper terminal row further includes two groups of first grounding terminals G1, G2 to space the differential signal terminal pairs S1, S2 along horizontal direction. The lower terminal row also has three groups of grounding terminals G3, G4, G5 being spaced by the pair of differential signal terminal pairs S3, S4. Each of the differential signal terminal pairs S1-S4 together with one of directly facing grounding terminals G1-G5 consist of a triangular configuration terminal group viewed from mating direction, such as S1 and G3, S3 and G1, and so on.

Figure 3:
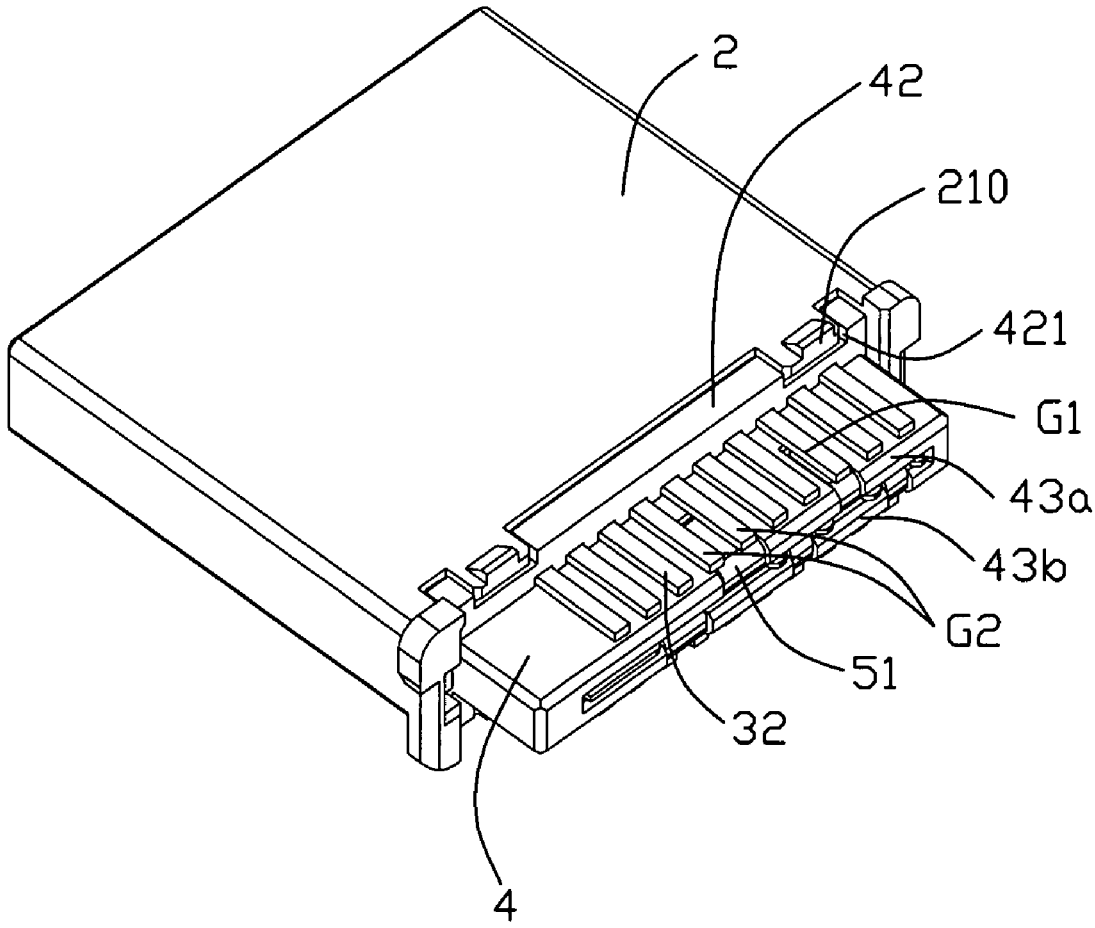
FIG. 3 is a partially assembled, perspective view of the cable connector.
Figure 4:
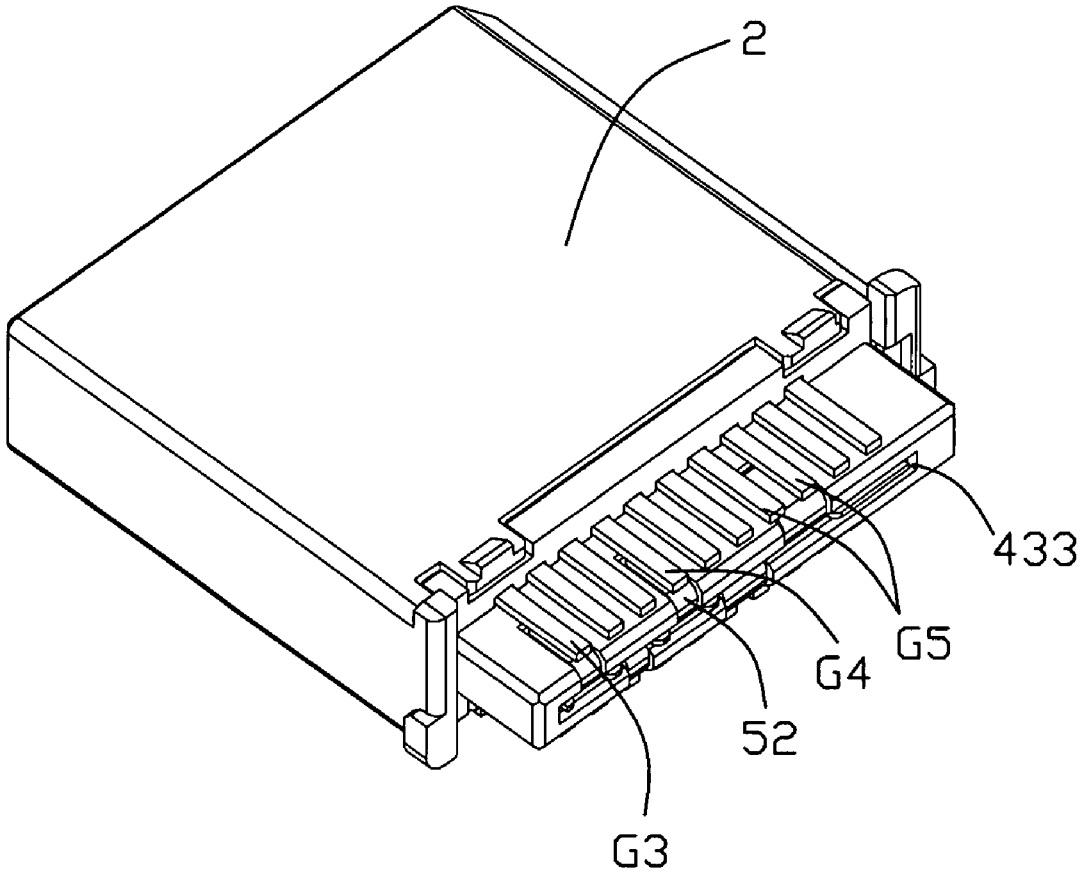
FIG. 4 is similar to FIG. 3, but viewed from another aspect.
Figure 5:
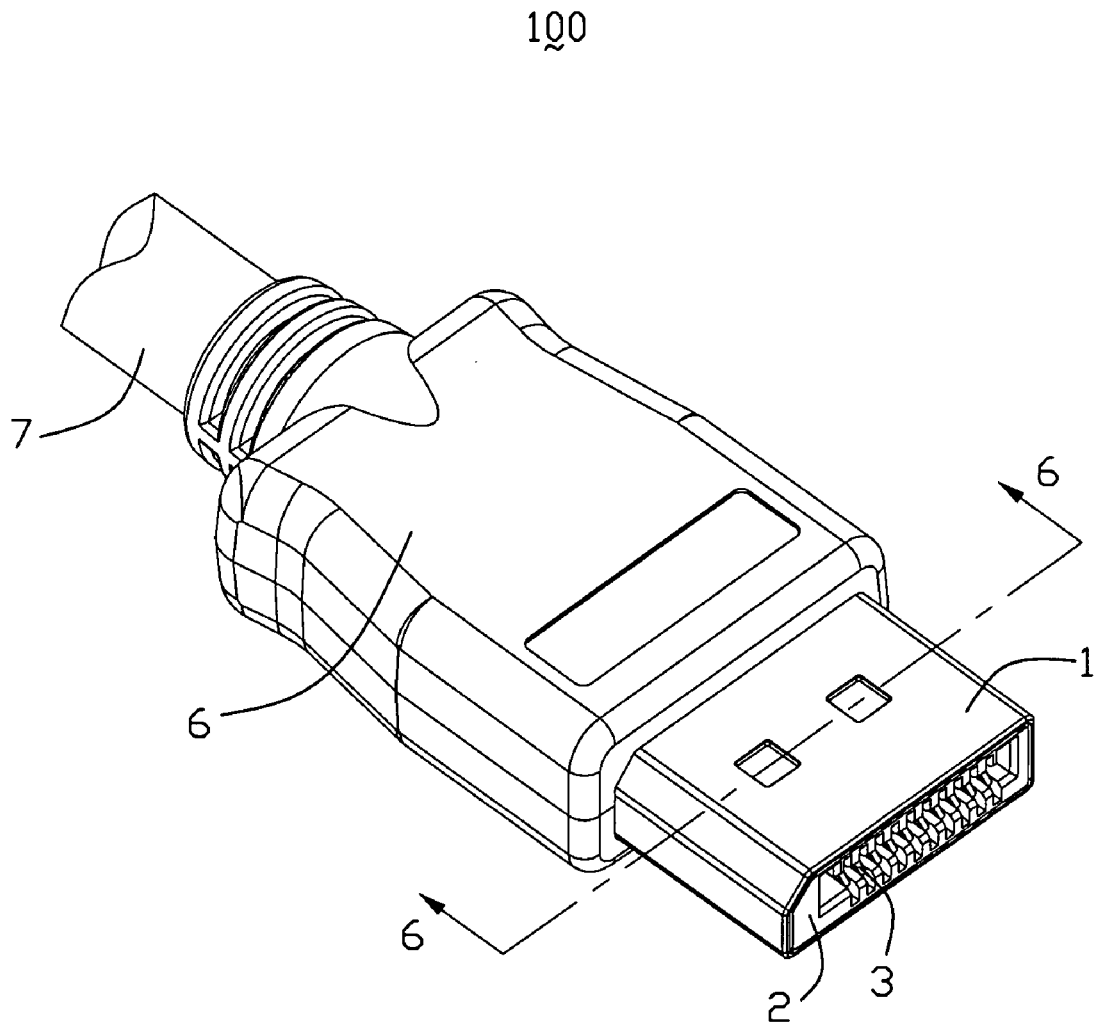
FIG. 5 is an assembled, perspective view of FIG. 1.

The spacer 4 comprises a base portion 43 and a tongue portion 41 extending forwardly from a front edge of the base portion 43. The base portion 43 defines a rectangular-shaped gap 433 (FIG. 4) which divides the base portion 43 into an upper wall 43*a* and a lower wall 43*b* (FIG. 3). The upper wall 43*a* of the base portion 43 defines two slots 431 recessed downwardly from upper surface thereof, including a large slot disposed in the middle section thereof and a small slot spaced away from the large slot 431. While the lower wall of the base portion 43 defines three slots 432 recessed upwardly from bottom surface thereof, including a large slot and two small slots spaced apart from one another. Both the upper wall 43*a* and the lower wall 43*b* of the base portion 43 further form a flange portion 42 adjacent to the tongue portion 41 respectively, and each flange portion 42 has a pair of cutouts 421 (FIG. 3) adjacent to opposite sides thereof. An upper portion and a lower portion of the tongue portion 41 have a plurality of terminal slots 411 arranged in a row by side-to-side manner, and the flange portions 42 also define a plurality of through holes (not numbered) each aligns with corresponding terminal slot 411.

The metal plate 5 is made of a sheet metal and comprises a panel portion 50 and a number of separated claws 51, 52 respectively bent upwardly and downwardly from a rear edge of the panel portion 50, thus the claws 51, 52 are separated into two distinct groups respectively disposed over and below the panel 50, and the two groups of claws 51, 52 are substantially parallel to the panel portion 50. Each claw 51 over the panel portion 50 is sizable with corresponding slot 431 of the upper wall 43*a* of the base portion 43 and each claw 52 below the panel portion 50 is suitable with corresponding slot 432 defined in the lower wall 43*b* of the base portion 43. The cable 7 includes a number of wires 71 separated into an upper row and a lower row. The wires 71 also have same arrangement as that of the terminals 3.

When assembly, firstly, the terminals 3 are arranged on the spacer 4, with the mating portions 33 located beyond a front end of the tongue portion 41, the body portions 31 located in the terminal slots 411 of the tongue portion 41, the termination portion 32 through the through holes of the flange portions 42 and disposed on the up and the bottom surfaces of the base portion 43. Secondly, the metal plate 5 is assembled to the spacer 4, with the panel portion 50 of the metal plate 5 inserted into the rectangular-shaped gap 433 and engaging with the base portion 43 via barbs (not numbered) thereof, the claws 51, 52 located in the slots 431, 432 of the upper and the lower walls 43*a*, 43*b* of the base portion 43. Then the termination portions 32 of corresponding grounding terminals G1-G2, G3-G5 contacting claws 51, 52 of the metal plate 5, respectively. Thirdly, the terminals 3 and the spacer 4 together are assembled to the insulated housing 2 till the flange portions 42 of the spacer 4 abuts against rear edge of the insulated housing 2, with the mating portions 33 of the terminals 3 received in the terminal passages 25 of the insulated housing 2, the tongue portion 41 of the spacer 4 received in the receiving space 20, the base portion 43 of the spacer 4 disposed outside the rear portion of the insulated housing 2, and the protruding portions 210 of the insulated housing 2 received in the cutouts 421 of the flange portions 42 of the spacer 4.

Fourthly, the wires 71 of the cable 7 are respectively soldered to the termination portions 32 of the terminals 3; fifthly, the insulated housing 2 is wrapped by the enclosing portion 11 of the upper first shield portion 1*a* of the metal shell 1, with the pair of locking members 211 of the two protruding portions 210 of the insulated housing 2 inserted into the pair of apertures 1131 of the rear section of the top side 113 of the enclosing portion 11, simultaneously, the base portion 43 of the spacer 4 and the exposed wires 71 are disposed in a rectangular space (not numbered) of the U-shaped bottom cover portion 12 of the metal shell 1. Then the lower second shield portion 1*b* is assembled to the upper first shield portion 1*a*, with the tabs 133 of the board portion 131 penetrating into corresponding holes 1110 of the top side 111, the locking tabs 134 of the upright sides 132 of the lower second shield portion 1*b* latching with the locking holes 123 of the upright sides 121 of the upper first shield portion 1*a*, then the cable holder 135 crimped to an end of the cable 7 and the stretching portion 124 of the first shield portion 1*a*, with the flat stopper 1241 of the stretching portion 124 abutting against a rear edge thereof. Sixthly, the cover 6 is molded over part of the metal shell 1 and the cable 7. In the present embodiment, as the metal plate 5 is located between the upper terminal row and the lower terminal row, and the metal plate 5 further electrically connecting with the grounding wires 71 of the cable 7, thus, the cross talk among terminals 3 will be greatly reduced or eliminated. Therefore, the signal quality/performance may be improved.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. A cable connector comprising:

an insulated housing defining a receiving space;

a plurality of terminals received in the insulated housing, said terminals being arranged into upper and lower terminal rows;

a metal plate disposed between the upper terminal row and the lower terminal row; and a cable including a number of wires electrically connecting to the terminals and the metal plate;

wherein the metal plate comprises a panel portion with a number of claws formed thereon to contact the grounding terminals.

2. The cable connector as claimed in claim 1, wherein the upper terminal row includes at least a pair of signal terminals to form a differential pair and the lower terminal row has at least a grounding terminal, and wherein the pair of signal terminals and the grounding terminal are arranged into triangular configuration.

3. A cable connector assembly comprising:

an insulative spacer in which two rows of contacts are disposed;

a metallic plate retained in the spacer and separating said two rows thus with one row of contacts on each side of the metal plate;

the spacer defining a mounting face, on which solder sections of said contacts are seated; and the metallic plate further defining at least one claw engaged with at least one solder section of the corresponding contact; wherein a plurality of wires respectively mechanically and electrically connected to the solder sections of the corresponding contacts.

4. The cable connector as claimed in claim 1, wherein the claws are respectively bent upwardly and downwardly from a rear edge of the panel portion, and wherein the claws are substantially parallel to the panel portion of the metal plate.

5. The cable connector as claimed in claim 1, further comprising a spacer which has a base portion and a tongue portion extending forwardly from an edge of the base portion assembled to the insulated housing.

6. The cable connector as claimed in claim 5, wherein the tongue portion of the spacer has a number of terminal slots, and wherein each of the terminals each has a body portion mounted in the terminal slot of the tongue portion, a mating portion extending forward from a front end of the body portion and disposed beyond a front end of the tongue portion, and a termination portion extending rearward from a back end of the body portion and disposed on the base portion of the spacer.

7. The cable connector as claimed in claim 6, wherein the mating portions of the terminals disposed in the receiving space of the insulated housing and the termination portions of the terminals extending beyond a rear surface of the insulated housing.

8. The cable connector as claimed in claim 5, further comprises a cover partially molded over the insulated housing, the spacer and the cable.

9. The cable connector as claimed in claim 1, further comprising a metal shell having a first shield portion and a second shield portion combined together.

10. The cable connector as claimed in claim 9, wherein the first shield portion includes an enclosing portion and an inverted U-shaped first cover portion engaging with the enclosing portion.

11. The cable connector as claimed in claim 9, wherein the second shield portion includes a U-shaped second cover portion and a cylindrical-shaped cable holder connecting to the U-shaped second cover portion.

12. A cable connector comprising:

an insulated housing including a top wall, an opposite bottom wall, and a pair of side walls connecting with the top and the bottom walls to form a receiving space;

a spacer partially received in the receiving space of the insulated housing;

a plurality of terminals arranged on both sides of the spacer and assembled to the insulated housing, said terminals including a number of grounding terminals and signal terminals;

a metal plate embedded in the spacer and contracting at least one grounding terminals; and a cable including a number of wires electrically connecting to the terminals;

wherein the metal plate includes a panel portion and two groups of claws engaging with the rear edge of the panel portion and wherein the panel portion of the metal plate is received in the rectangular-shaped gap of the base portion and each of the claws of the metal plate is located in a corresponding slot of the base portion of the spacer.

13. The cable connector as claimed in claim 12, wherein the spacer has a base portion with a substantially rectangular-shaped gap therein, wherein the base portion is separated into an upper wall and a lower wall by the rectangular-shaped gap, and wherein the upper wall and the lower wall of the base portion respectively define a number of spaced apart slots thereon.

14. The cable connector as claimed in claim 13, wherein the spacer further defines a tongue portion inserted into the receiving space of the insulated housing and a flange portion formed on the base portion abutting against a rear edge of the insulated housing, and wherein the base portion is arranged outside of the insulated housing.

15. The cable connector assembly as claimed in claim 3, wherein said claw is located under said at least one solder section of the corresponding contact while the corresponding wire is located on said at least one solder section of the corresponding contact opposite to the claw.

16. The cable connector as claimed in claim 12, wherein each of the terminals comprises a flat body portion, a curved mating portion extending forward from a front end of the body portion, and a flat termination portion extending rearward from a rear end of the body portion.

17. The cable connector as claimed in claim 16, wherein the termination portions of the terminals are arranged on the upper wall and a lower wall of the base portion, and wherein the termination portions of the grounding terminals contact the claws of the metal plate to form electrical connection.

18. The cable connector assembly as claim in claim 15, wherein said spacer defines at least one recess located under the mounting face and receiving said claw.

* * * * *